United States Patent [19]

Andoniev et al.

[11] 3,966,179

[45] June 29, 1976

[54] APPARATUS FOR EVAPORATIVE COOLING OF METALLURGICAL PLANTS

[76] Inventors: Sergei Mikhailovich Andoniev, prospekt Pravdy, 5, kv. 60; Leonid Borisovich Zilberman, ulitsa Ekonomicheskaya, 1a, kv. 12; Gennady Alexandrovich Kudinov, prospekt Gagarina, 32, kv. 203; Dorina Borisovna Kutsykovich, prospekt Lenina, 39, kv. 54; Oleg Vladimirovich Filipiev, prospekt Pravdy, 5, kv. 41; Grigory Ivanovich Kasyanov, prospekt Lenina, 64b, kv. 63; Grigory Borisovich Zalmanovich, 602 mikroraion, 33, kv. 37; Jury Borisovich Raikovsky, prospekt Lenina, 11, kv. 34, all of Kharkov, U.S.S.R.

[22] Filed: July 18, 1974

[21] Appl. No.: 489,839

[52] U.S. Cl. ..... 266/193

[51] Int. Cl.[2] ..... C21B 7/10

[58] Field of Search ..... 266/32; 432/238

[56] References Cited

UNITED STATES PATENTS 3,818,870 6/1974 Andoniev et al. ..... 266/32 X

FOREIGN PATENTS OR APPLICATIONS 1,204,273 9/1970 United Kingdom ..... 266/32

*Primary Examiner*—Gerald A. Dost

*Attorney, Agent, or Firm*—Haseltine, Lake & Waters

[57] ABSTRACT

An apparatus comprising one or more closed systems for the natural circulation of cooling water, comprising a cooling-water manifold, a pipeline for feeding water from the manifold to one or more coolers or cooler sections in the system, and steam-water pipelines for discharging the mixture from the coolers. Each cooler or section may be provided with an individual steam separator communicating with its steam outlet to an associated discharge pipeline, and connected with its water side to the steam side of the manifold.

3 Claims, 3 Drawing Figures

APPARATUS FOR EVAPORATIVE COOLING OF METALLURGICAL PLANTS

This invention relates to the field of metallurgy and, more particularly, to an apparatus for the evaporative cooling of metallurgical plants. It may be used for cooling, for example, blast-furnace casings, other heated parts of blast furnaces, valves of air heaters, etc.

Known in the art is an apparatus for evaporative cooling of heated parts of metallurgical plants, that apparatus being provided with a closed system for the natural circulation of the cooling water.

The conventional device comprises a cooling water manifold and coolers mounted at the zones to be cooled. Each of the coolers is connected to the manifold by means of an individual pipeline adapted to supply cooling water. Each of the coolers is also provided with an individual pipeline that is used to discharge a liquid-vapor mixture, formed as a result of the action of the heat flow on the cooler, to the manifold connected to a separating tank. The latter is adapted to separate steam from water as well as to store cooling water.

The water separated from the steam is fed from the separating tank to the manifold with the cooling water. To compensate for leakages of water from the closed system, the separating tank is periodically supplied with an additional amount of water.

The main disadvantage of the conventional apparatus consists in the fact that after the liquid-vapor mixture from the coolers, operating under different thermal loads, (i.e. having different flow rates of cooling water circulating in the system) has entered the common discharge manifold, pulsations occur in the cooling water flow in the system. This results in unreliable cooling due to water hammers and vibrations arising in the coolers. The pulsations in the circulation flow of water also lead to steam moisturing and to a sharp increase of the water level in the separating tank due to substantial discharge of the circulating water from the discharging manifold. This action derives from the fact that the increase in the water level in the separating tank cuts the height of the steam space and sets up conditions for entraining coarser water drops by the steam. This fact gives rise to an increase in the consumption both of the supply the water and of electric energy for water supplying pumps.

Another disadvantage of the conventional apparatus consists in a great amount of metal used for the manufacture of pipelines, as well as in a concentrated static load caused by the separating tank with the weight of water and insulation, which calls for the use of a heavy supporting structure mounted at a significant height of the plant.

An object of the present invention is to provide an apparatus for the evaporative cooling of heated parts of metallurgical plants, that ensures effective cooling of the plants.

Another object of the invention is to improve the quality of steam due to the efficient drying thereof.

It is also an object of the invention to reduce the consumption of metal used for the manufacture of communicating pipelines.

These objects are achieved in the inventive apparatus for the evaporative cooling of heated parts of metallurgical plants, comprising a closed system for the natural circulation of cooling water, wherein a number or groups of coolers is/are provided, each with an individual steam separator connected to an associated liquid-vapor discharge pipeline and communicated at the water-space side to the steam-space side of a cooling water manifold, the steam outlets of all separators being interconnected by means of a common pipeline. Separate closed circulation systems may also be provided for individual or interconnected sections of the coolers.

Such an arrangement makes it possible, due to the introduction into each of the coolers of an individual steam separator connected to the liquid-vapor mixture pipeline and communicated with the manifold at the steam side thereof, to substantially reduce vibration and water hammers in the coolers, as well as pulse flow of the cooling water in the circulating system, to increase reliability of cooling, to improve the quality of steam, to reduce the consumption of metal used for the manufacture of the communicating pipelines, and to reduce the time required for putting the apparatus into commerical operation.

According to the invention, the cooling water manifold may be divided into separate sections according to the number of coolers, these sections being interconnected separately at the steam and water sides thereof. This arrangement makes it possible to mount each cooler without stopping the plant as a whole.

The invention will now be explained in greater detail with reference to a specific, exemplary embodiment thereof which is represented in the accompanying drawings, wherein.

Figure 1:
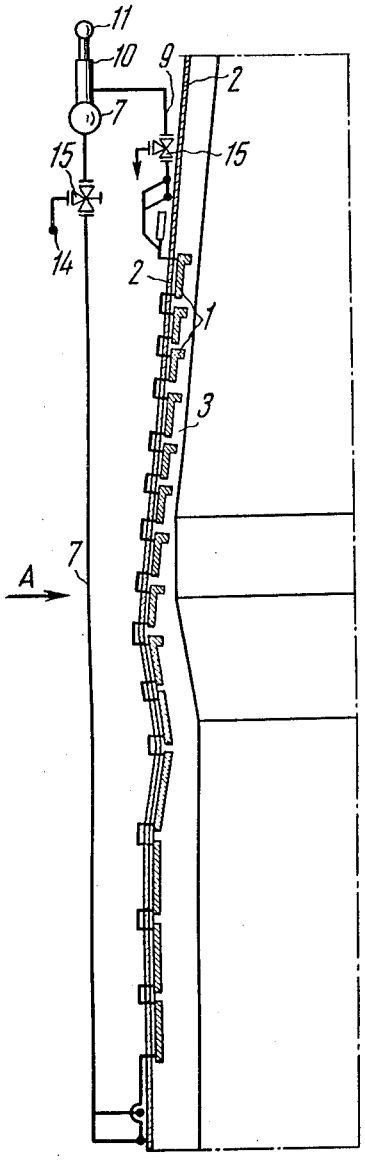
FIG. 1 is a schematic view in side elevation of an inventive apparatus for evaporative cooling of a blast furnace.

The inventive device for evaporative cooling comprises cooling plates 1 (FIGS. 1 and 2) made of cast iron and accommodated in a space between a casing 2 and a furnace lining 3 along the peripherical and vertical extent of the blast furnace. As the plates 1 receive the heat generated during the operation of the furnace, they have to be constantly cooled. To this end, the cooling plates 1 are provided with coiled cooling pipes 4 (FIG. 2) rigidly fixed thereto, the pipes being vertically interconnected in series by means of pipes 5.

A set of vertically arranged and interconnected plates 1 constitutes a cooler 6 of which there may be more, as will be explained later in full detail. Those of the pipes 4 which are located in any first cooling plate of the cooler 6 (i.e. the first one located downstream the cooling water flow, see arrows in FIG. 2) are connected to a cooling water supply pipeline 7 (FIG. 1; 2) which, in turn, is connected to a cooling water manifold 8. The pipes 4 in the last (i.e. the last one located downstream the cooling water flow) cooling plate of the cooler 6 are connected to a pipeline 9 adapted to discharge the liquid-vapor mixture formed as a result of the action of the heat flow on the cooler, each pipeline 9 being communicated with a steam separator 10. The latter is connected at its lower or water-space side to the steam-space side or top of the manifold 8.

Figure 2:
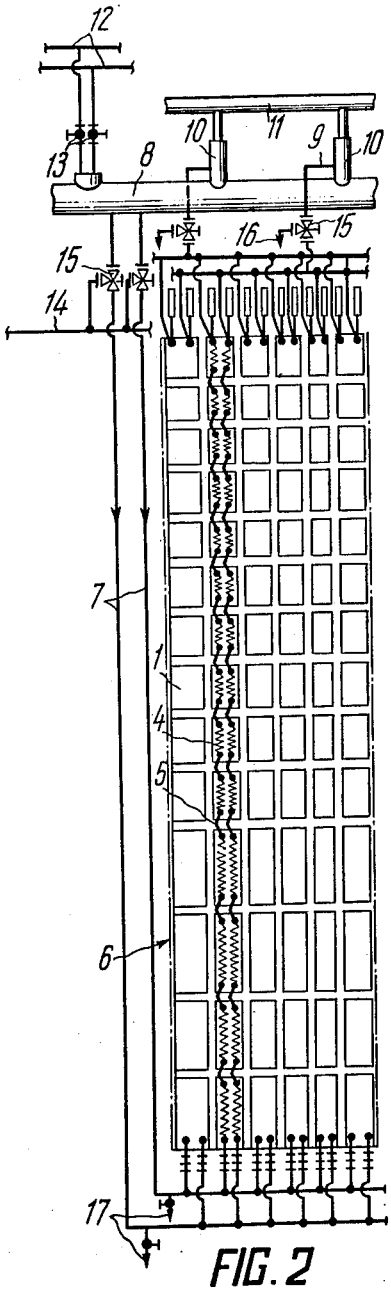
FIG. 2 is a view in the direction of arrow A in FIG. 1.

It will be understood from the illustration of FIG. 2 that each cooler 6 may have one or two sections therein, the latter being connected in parallel to the earlier-described pipeline 7 in which case there are two of them, as shown. Each cooler section has an intermittently disposed row of pipes 4 and 5 therein. The manifold 8 supplying the cooling water, followed by one or more pipelines 7, coolers 6, liquid-vapor mixture discharge pipelines 9 and steam separators 10, constitute in combination a closed circuit for the natural circulation of the cooling water. The number of such closed circuits in the apparatus corresponds to the number of the coolers 6 or their sections, as explained, and, therefore, each of the closed circuits is provided with an individual steam separator 10. The steam outlets at the tops of the separators are interconnected by means of a common pipeline 11 for steam removal.

Chemically clean, and deaerated cooling water is supplied to the manifold 8 from a central pumping station of a deaerator unit along two pipelines 12, as will be explained later through water level regulators 13 adapted to maintain a predetermined level of water in the water manifold 8.

For the sake of safety, the apparatus is provided during repair and maintenance with a pipeline 14 supplying industrial water to the cooling circuit (see FIGS. 1 and 2) through three-way valves 15 adapted to change-over the apparatus from evaporative cooling to flowwater cooling, these valves being included into each supply pipeline 7 and each discharge pipeline 9. The three-way valves 15 mounted in the latter communicate with a sewerage by respective pipelines 16. Valves 17 are provided for draining from the lowest points of the supply pipelines 6. In a manner similar to that described for the separate water supply pipelines 7, each for one or more of the cooler sections, separate pipes may be disposed between the tops of the pipe chains 4, 5, before reaching the valves 15.

Figure 3:
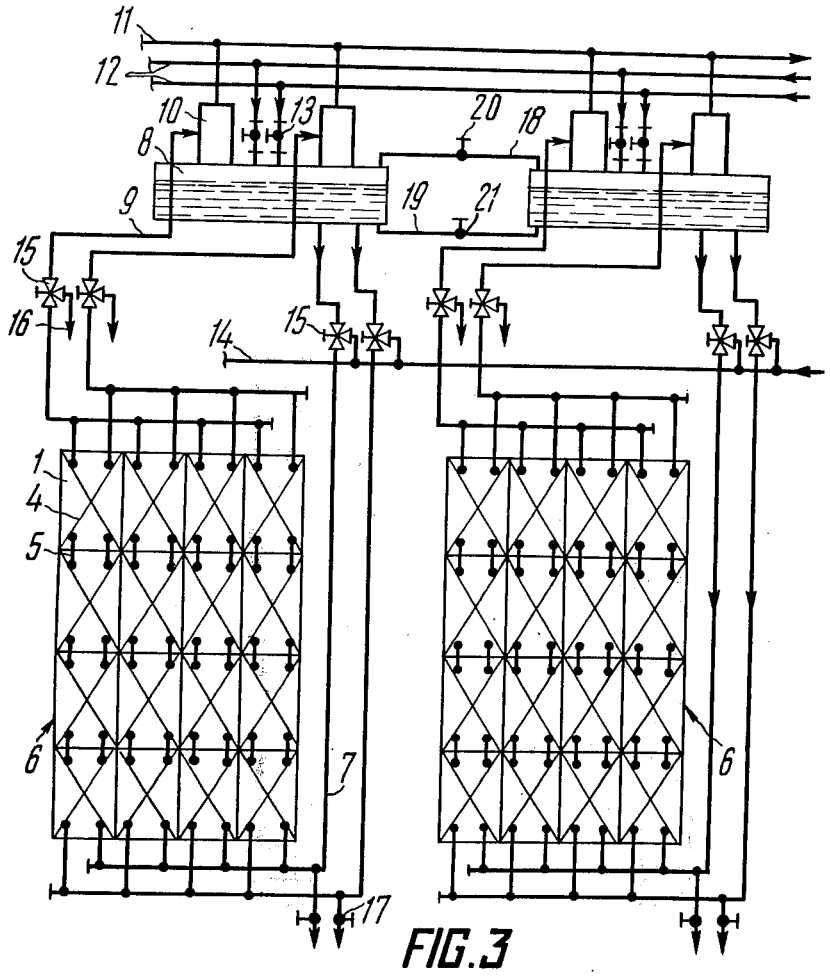
FIG. 3 is a schematic illustration showing closed loops for natural circulation made with a manifold divided into separate sections.

To ensure flow-line assembly of the apparatus and create coolers 6 that are independent of each other, the cooling water manifold 8 may be divided into separate sections according to the number of coolers 6 or sections thereof, in the apparatus, the sections are interconnected separately at the steam and water sides thereof (see FIG. 3) by pipelines 18 and 19 with the use of valves 20 and 21 respectively. In this case each of the sections in the manifold 8 is provided with a self-contained system for supplying chemically clear water.

OPERATION OF THE APPARATUS

Before putting the apparatus into service it is necessary to clean the circulation lines from dirt and foreign particles by passing therethrough a flow of water.

To this end, the three-way valves 15 in the pipelines 7 and 9 (FIG. 1 and 2) are set to the position wherein industrial water is fed from and through the pipelines 14, 7 into the circulation circuit, and then it is freely discharged through the pipeline 9 to the sewerage by means of one or more of the pipelines 16.

Then, the respective three-way valve 15 in the supply pipeline 7 is switched to a position wherein the supply of industrial water is cut off from the circulation circuits. Following this the level regulators 13 and the valves 17 for draining from the lowest points of the supply pipeline 7 are opened. Hereafter the chemically clean and deaerated water can be fed to clean, and thereafter to fill, the water manifold 8, namely through pipes 12.

After finishing the cleaning procedure, cut-off and regulating valves 15, 17 are switched to the position for evaporative cooling thereby preventing the leakage of the cooling water.

Before setting it into operation the evaporative cooling apparatus is filled with the chemically clean water fed through the pipes 12 from a central pumping station of a deaerator unit. To accomplish this, the draining valves 17 are closed while the valves 15 are set into the position ensuring free circulation of the clean water in the closed circuits while preventing leakages and entering of the industrial water into the closed circuit.

The apparatus is filled with the clean water through the manifold 8 from the pipelines 12 until the water raises to the predetermined controlled by the level regulators 13.

The feeding of the heat flow to the cooling plates 1 causes the heating of the water in the pipes 4. The heating of the water changes its specific gravity. The difference in the specific gravities of the water in the supply pipelines 7 and in the pipes 4 sets the water in motion, i.e. natural circulation of the water occurs in the cooling circuits. This action is based on the principle that the liquid-vapor mixture which is lighter than water is displaced from the pipelines 6 and guided through the discharge pipeline 9 into the steam separators 10 communicated with the steam space of the water manifold 8.

In the separators 10 the steam is separated from the water, the steam then being removed via the pipeline 11 while the water flows down to the water space of the manifold 8 and reenters the circulating systems of the coolers.

With the opened level regulators 13 the evaporation losses are compensated by feeding the chemically clean water from the pipelines 12.

During the repair and preventive maintenance, for the sake of safety, the apparatus is switched to the condition for cooling by industrial water.

To this end, with atmospheric pressure in the water manifold 8, the three-way valves 15 are switched to the position which ensures the admission of the industrial water from the pipeline 14 to the supply pipeline 7 with the subsequent discharging of the water from the pipeline 9 and through the pipelines 16 to the sewerage while preventing admission of the chemically clean water from the supply pipes 12 and into the water manifold 8.

Thus, the present invention, due to the introduction into each of the coolers of an individual steam separator connected to the liquid-vapor mixture discharge pipeline and communicated with the cooling water manifold at the steam-space side thereof, ensures stable flow conditions for the cooling medium and thereby provides reliable cooling of the plant, improves the quality of steam, reduces the consumption of metal used for the manufacture of the communicating pipelines, and reduces the time required for placing the apparatus in commercial operation.

The separation of the manifold for cooling water into separate sections sets up conditions for assembling the evaporative cooling apparatus in a flow-line manner and independently of the operation of the coolers.

What is claimed is:

1. An apparatus for the evaporative cooling of metallurgical plants, comprising, in combination: at least one closed system for the natural circulation of cooling water, each system including an individually mountable cooler having at least two sections therein with a plurality of cooling plates including coiled pipes, intermittently connected in a substantially vertical direction by intermediate pipes, thus forming at least two separate circulation loops in said cooler sections; at least one common water-supply pipeline connected to the lower end of at least one of said cooler sections, and separate pipes connected to the upper ends of said sections for discharging a steam and water mixture; at least one common cooling-water manifold disposed above said coolers and feeding water from its lower water side through respective closable pipelines to said common supply pipelines; and steam separators arranged above said common manifold, individually for at least one group of said cooler sections; said discharging pipes leading individually to said separators; the latter being individually connected with their lower water sides to the upper steam sides of said common manifold, while upper steam outlets of said separators are similarly individually connected to a common discharging pipeline, and means for rinsing said closed system from dirt and foreign particles by passing therethrough a flow of water, including inlet and outlet valves associated with said closable pipelines and said lower ends of the cooler sections.

2. The apparatus as defined in claim 1, wherein said common manifold has at least two sections, each for connecting thereto said separate discharging pipe of at least one cooler section, and further comprising pipes interconnecting said manifold sections at both the lower water sides and said upper steam sides thereof.

3. The apparatus as defined in claim 1, further comprising parallel-connecting pipes between said at least one closed system and at least one of said common supply pipelines and said separate discharging pipes.

* * * * *